US012173470B2

(12) United States Patent
Paull

(10) Patent No.: US 12,173,470 B2
(45) Date of Patent: Dec. 24, 2024

(54) APPARATUS AND METHOD FOR ENHANCED SKID LOADER GRADING CONTROL

(71) Applicant: Phil Paull, Noblesville, IN (US)

(72) Inventor: Phil Paull, Noblesville, IN (US)

( * ) Notice: Subject to any disclaimer, the term of this patent is extended or adjusted under 35 U.S.C. 154(b) by 369 days.

(21) Appl. No.: 17/490,051

(22) Filed: Sep. 30, 2021

(65) Prior Publication Data

US 2022/0127818 A1 Apr. 28, 2022

Related U.S. Application Data

(60) Provisional application No. 63/106,085, filed on Oct. 27, 2020.

(51) Int. Cl.

| | |
|---|---|
| ***E02F 3/84*** | (2006.01) |
| ***E02F 3/815*** | (2006.01) |
| *E02F 3/76* | (2006.01) |
| *E02F 9/20* | (2006.01) |

(52) U.S. Cl.
CPC ..... *E02F 3/847* (2013.01); *E02F 3/815* (2013.01)

(58) Field of Classification Search
None
See application file for complete search history.

(56) References Cited

U.S. PATENT DOCUMENTS

| | | | | |
|---|---|---|---|---|
| 3,512,589 A * | 5/1970 | Ulrich | E02F 3/815 172/791 |
| 5,775,438 A * | 7/1998 | Confoey | E02F 3/815 172/811 |
| 6,035,944 A * | 3/2000 | Neuner | E02F 3/815 37/468 |
| 6,322,287 B1 * | 11/2001 | Yelton | E01C 19/15 404/98 |
| 2019/0276999 A1 * | 9/2019 | Holman | E01H 5/062 |
| 2021/0131059 A1 * | 5/2021 | Thiessen | E02F 3/3609 |
| 2022/0090349 A1 * | 3/2022 | Wuisan | E02F 3/8152 |

FOREIGN PATENT DOCUMENTS

| | | | |
|---|---|---|---|
| WO | WO-2022058468 A1 * | 3/2022 | E02F 3/7631 |

* cited by examiner

*Primary Examiner* — Aniss Chad
*Assistant Examiner* — Madison R. Inserra
(74) *Attorney, Agent, or Firm* — David E. Novak; Brannon Sowers & Cracraft PC

(57) ABSTRACT

A skid loader blade assembly, including a connection plate, at least one vertical actuator operationally connected to the connection plate for moving a blade relative to the plate, and a hinged blade operationally connected to the vertical actuator. The hinged blade further includes a hinge, a first blade portion connected to the hinge, and a second, oppositely disposed blade portion connected to the hinge. The skid loader blade assembly also includes a first pivot actuator operationally connected to the first blade portion and a second pivot actuator operationally connected to the second blade portion.

10 Claims, 12 Drawing Sheets

APPARATUS AND METHOD FOR ENHANCED SKID LOADER GRADING CONTROL

CROSS-REFERENCE TO RELATED APPLICATIONS

The patent application claims priority to co-pending U.S. provisional patent application Ser. No. 63/106,085, filed on Oct. 1, 2021.

TECHNICAL FIELD

The present novel technology relates generally to the field of mechanical engineering, and, more particularly, to a method and apparatus for enhancing stability and control of a skid loader-type digging machine.

BACKGROUND

Keeping on grade while digging with a skid loader continues to be a challenge even for the most experienced operators. More so than most digging machines, the light weight and compact size of the skid loader make controlling the front blade difficult as the machine bounces along. This issue is compounded as the blade is held by an extended lever arm while the applied downward grading and/or digging forces applied produce unwanted wiggling and vibration of the arm and blade/bucket. Even experienced operators, having developed a tactile 'feel' for how well the blade and/or bucket attachment is cutting and/or digging, have difficulty maintaining grade. The more precisely the grade must be maintained, the more difficult and draining the job. While very good operators are able to maintain grade reasonably well even over prolonged sessions, the effort does take its toll both physically and mentally.

Conventional laser alignment and even GPS-guided devices have been developed to give the operator more reliable feedback regarding how close the digging bucket is to the desired grade. Such devices provide feedback to the operator that the bucket is too high, too low, or on grade at any given time during the digging operation. However, the operator must still receive and manually respond to the feedback signals (i.e., up or down) provided by the devices. Such constant correction of the bucket depth has proven to be physically demanding and exhausting.

Skid loaders may be equipped with buckets or flat blades. When using a flat blade, the center of gravity of the skid loader tends to be too far forward for easy control of the machine, and the skid loader has a tendency to want to seesaw when encountering a heavy obstacle.

Thus, there is a need for a system for automatically enhancing control of the skid loader when digging and for automatically keeping the excavation on a predetermined grade. The present novel technology addresses this need.

DETAILED DESCRIPTION

Figure 1:
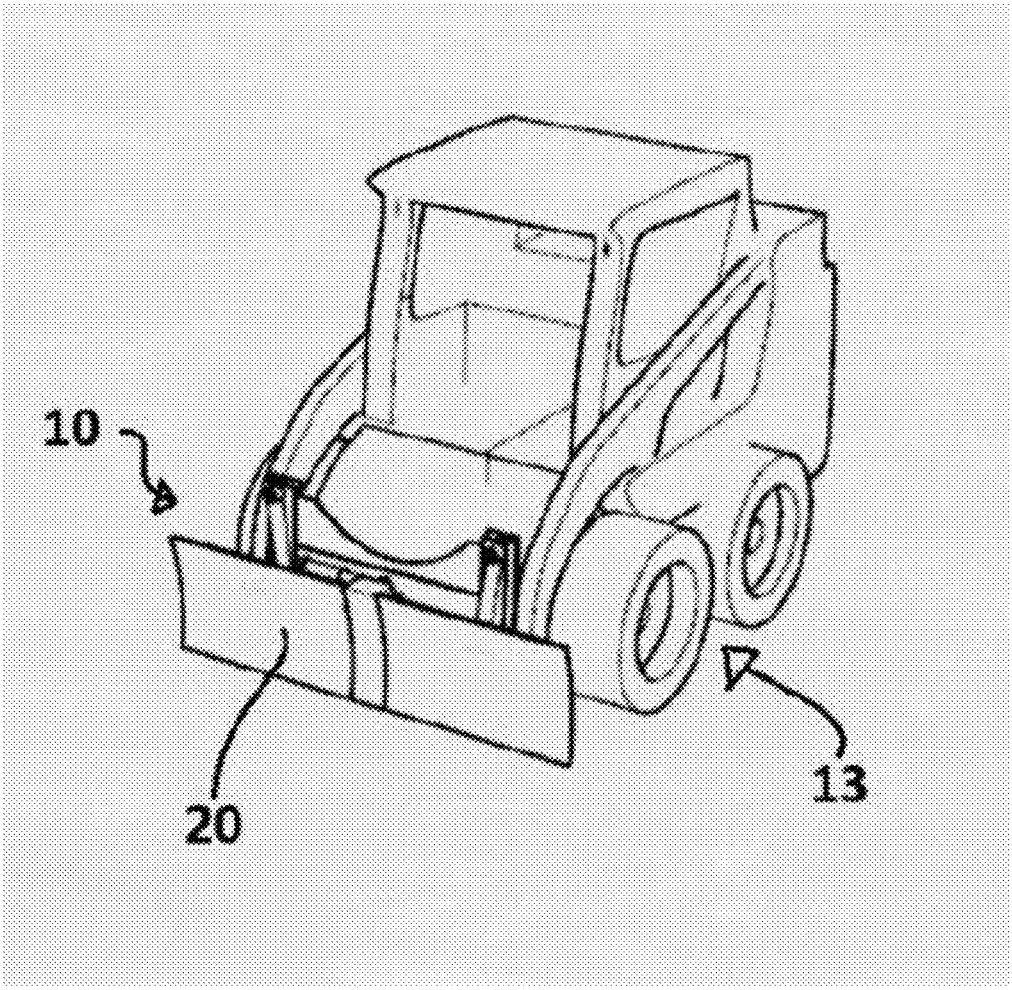
FIG. 1 is a perspective view of a first embodiment blade assembly as attached to a skid loader.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

Figure 2:
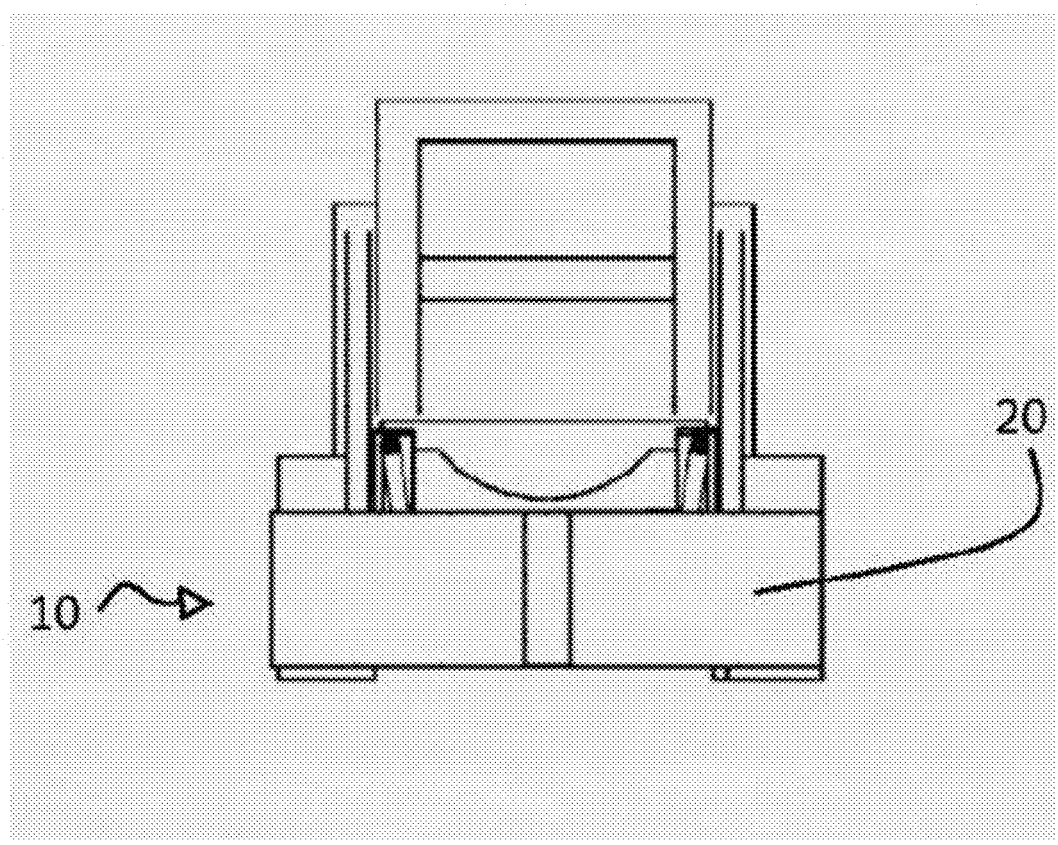
FIG. 2 is a first front elevation view of FIG. 1.
Figure 3:
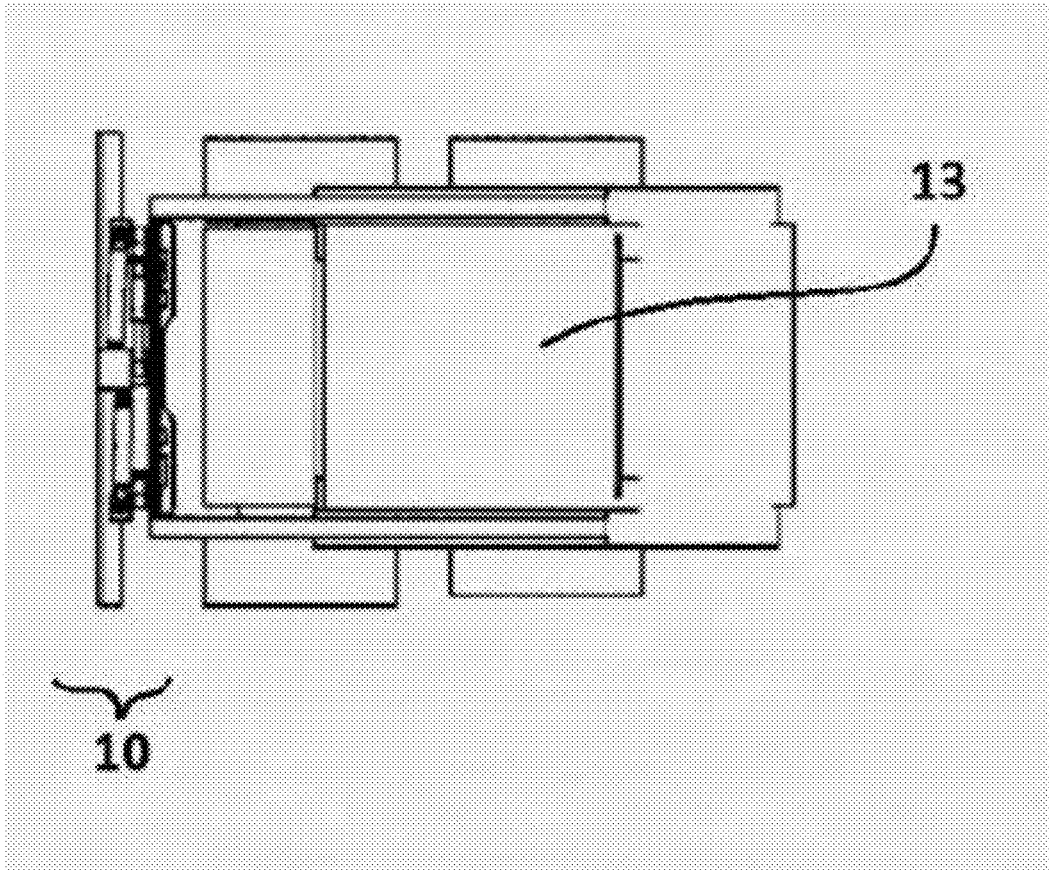
FIG. 3 is a first top plan view of FIG. 1.
Figure 4:
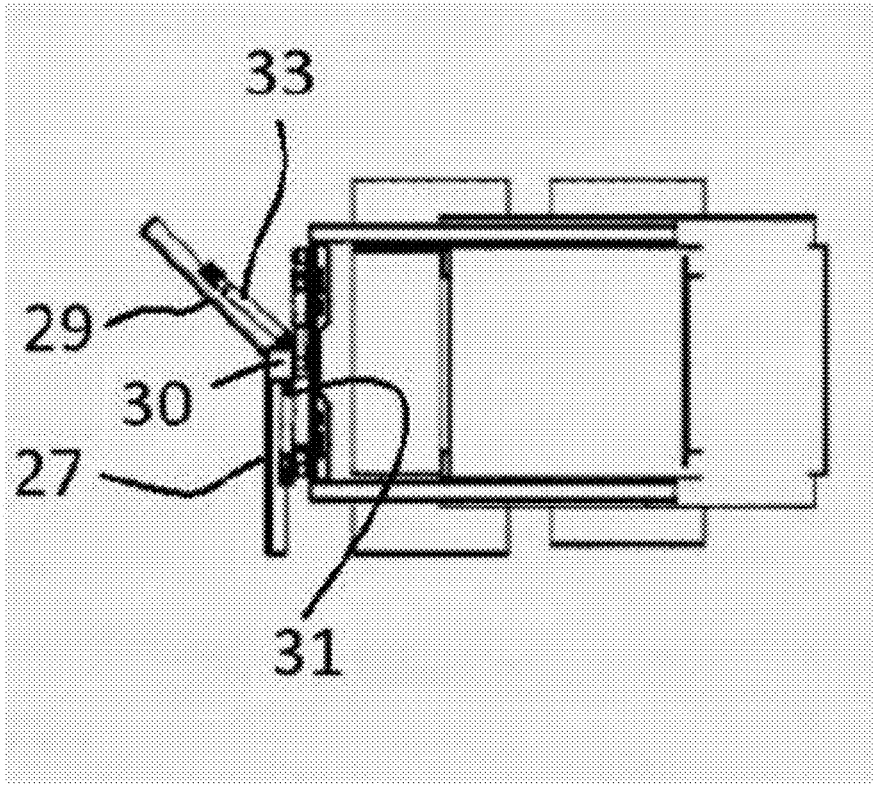
FIG. 4 is a second top plan view of FIG. 1 with one blade portion pivoted forward.
Figure 5:
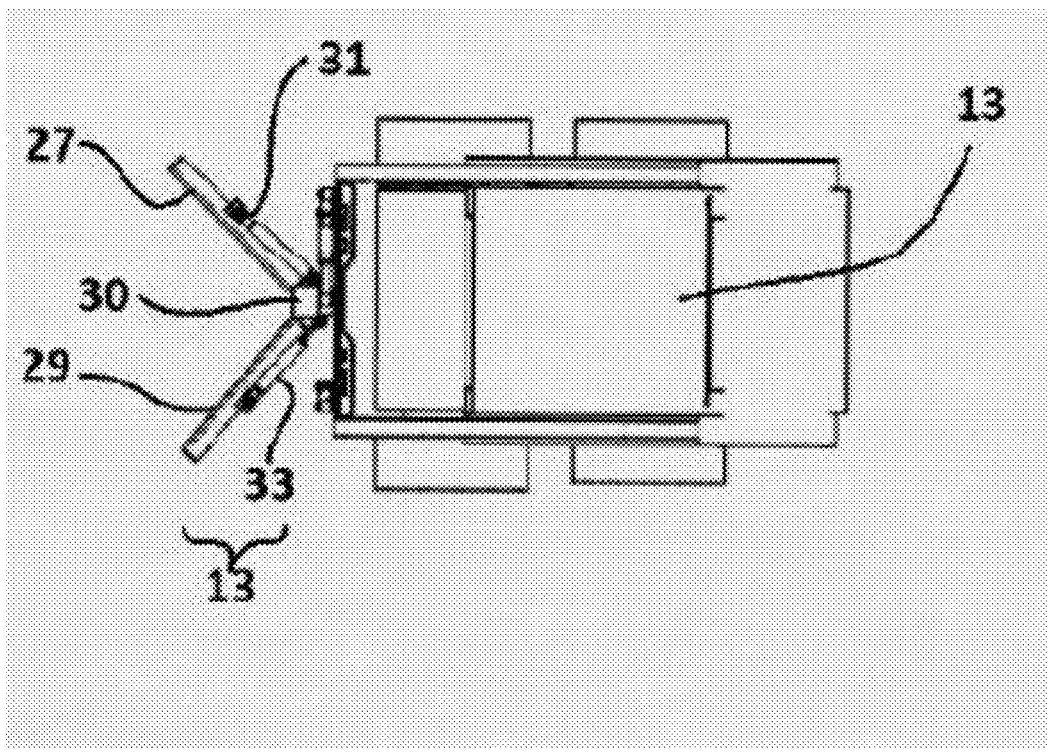
FIG. 5 is a third top plan view of FIG. 1 with both blade portions pivoted forward.
Figure 6:
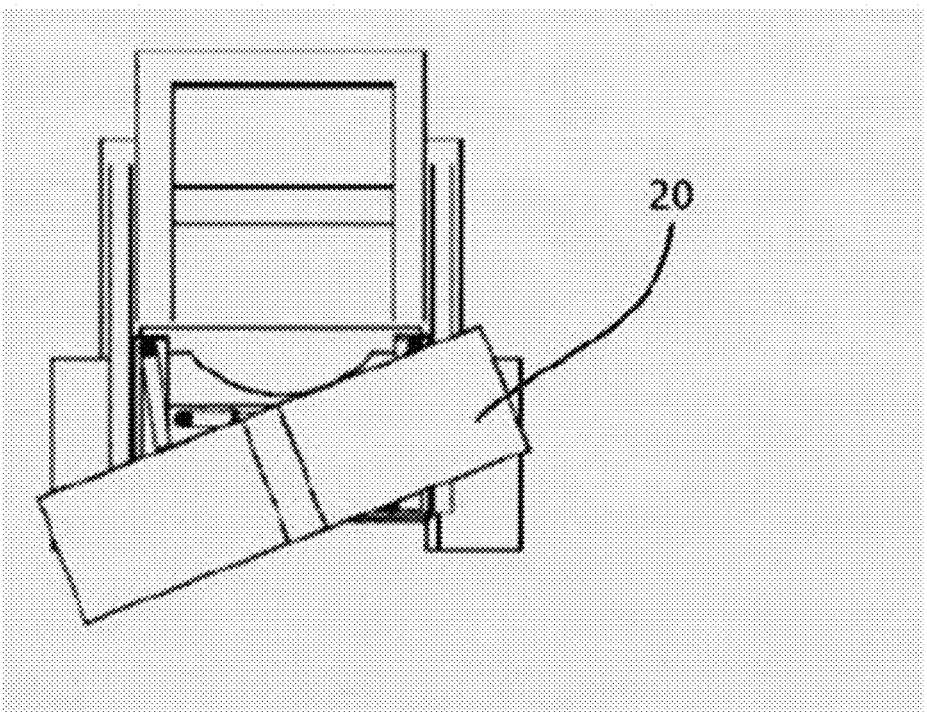
FIG. 6 is a second front elevation view of FIG. 1 with the blade pivoted.
Figure 7:
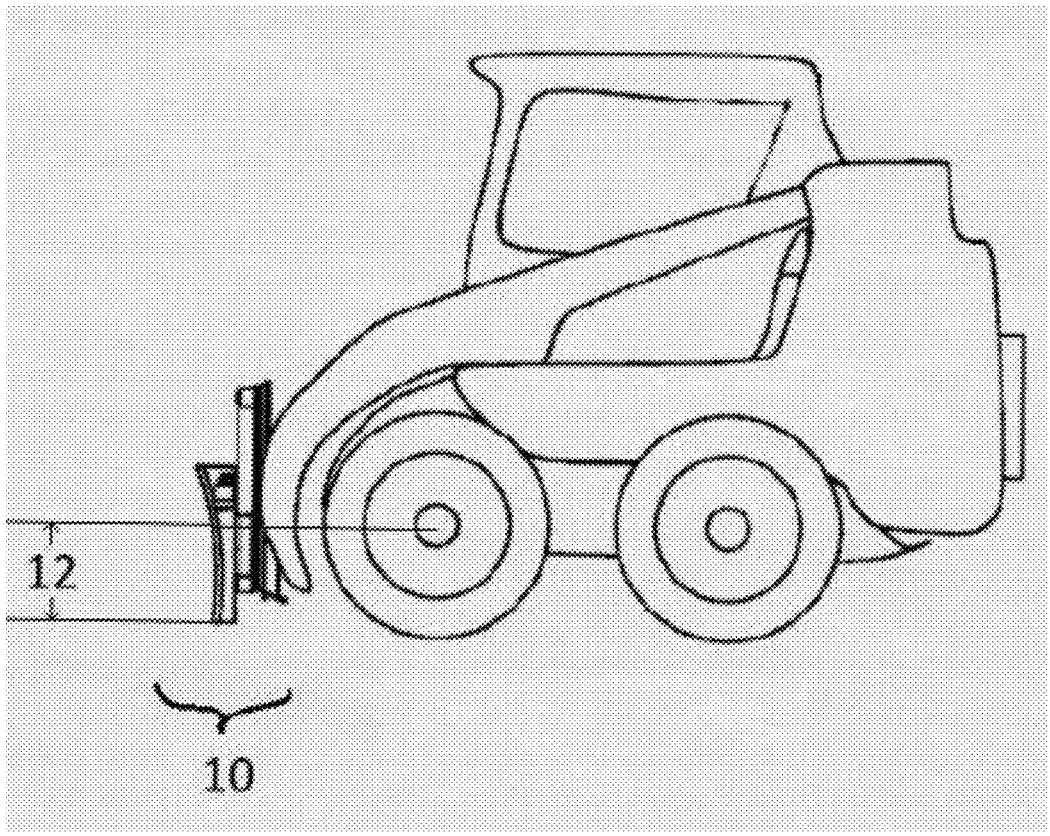
FIG. 7 is a first side elevation view of FIG. 1 with the blade lowered.
Figure 8:
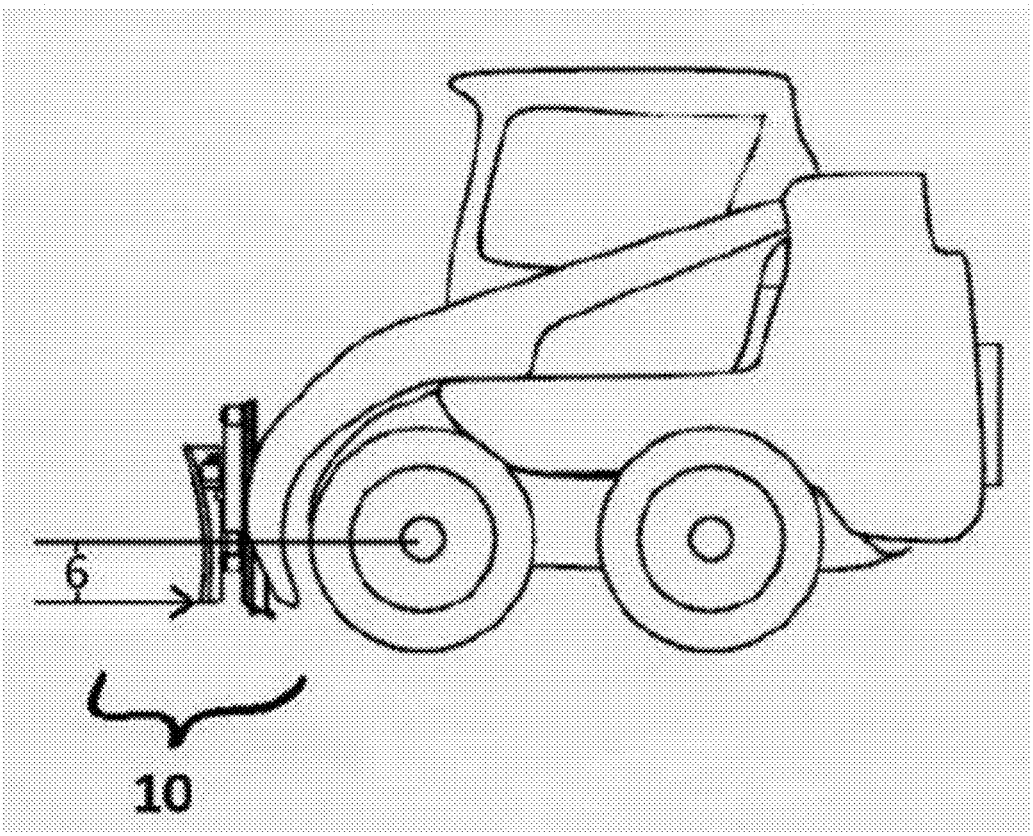
FIG. 8 is a second side elevation view of FIG. 1 with the blade raised.
Figure 9:
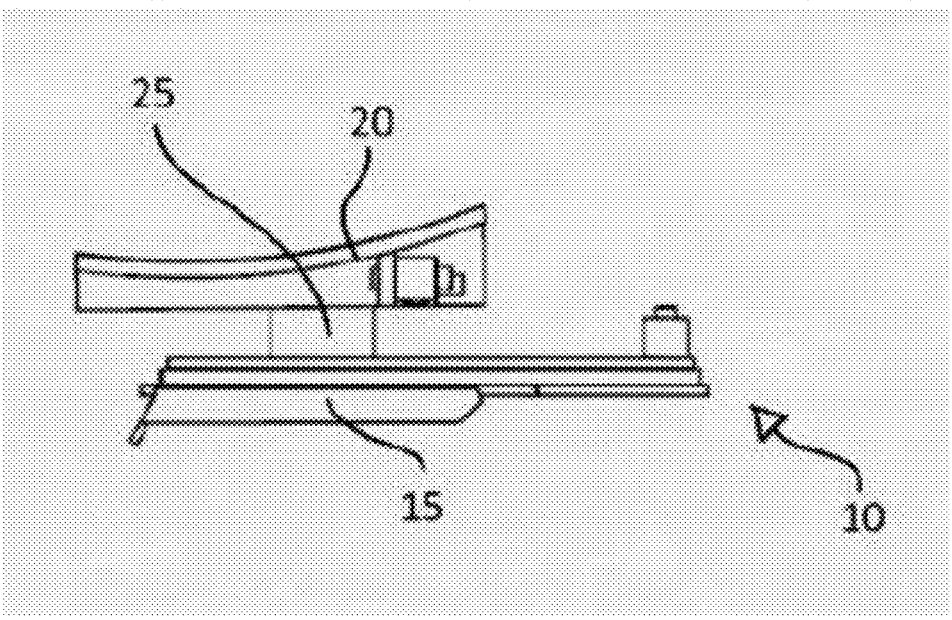
FIG. 9 is a side schematic view of the blade connection assembly.
Figure 10:
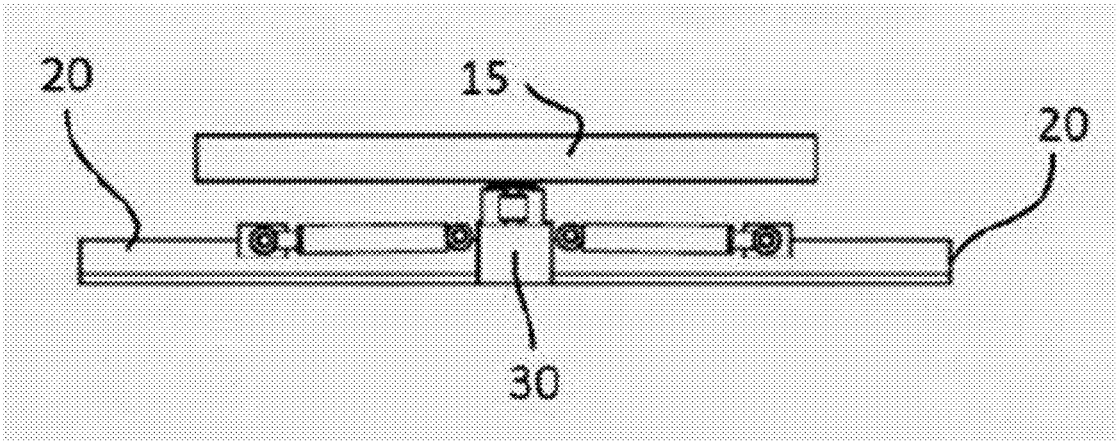
FIG. 10 is a first top schematic view of the blade connection assembly of FIG. 9.
Figure 11:
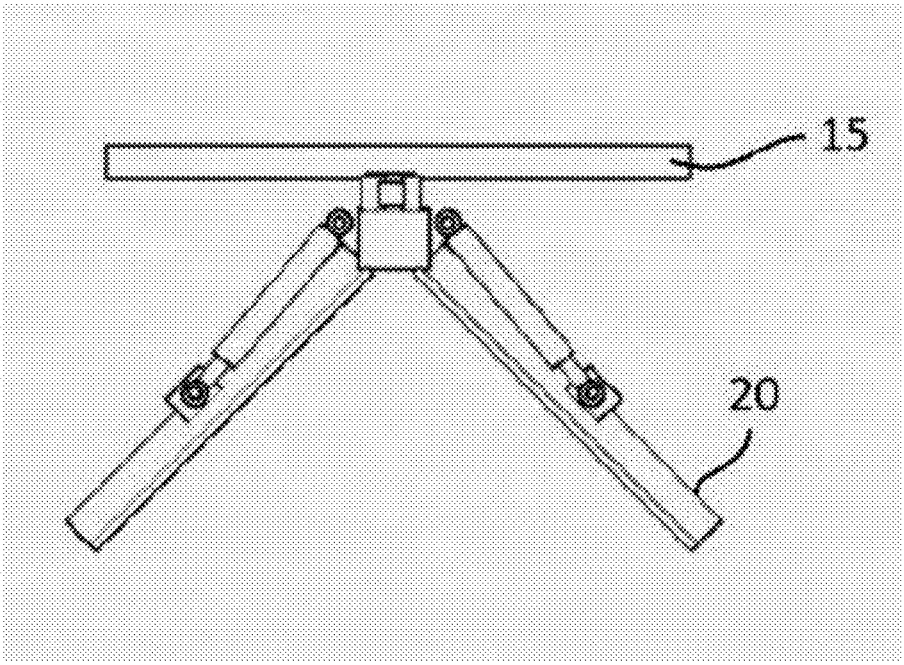
FIG. 11 is a second top schematic view of the blade connection assembly of FIG. 9 with the blade portions pivoted forward.
Figure 12:
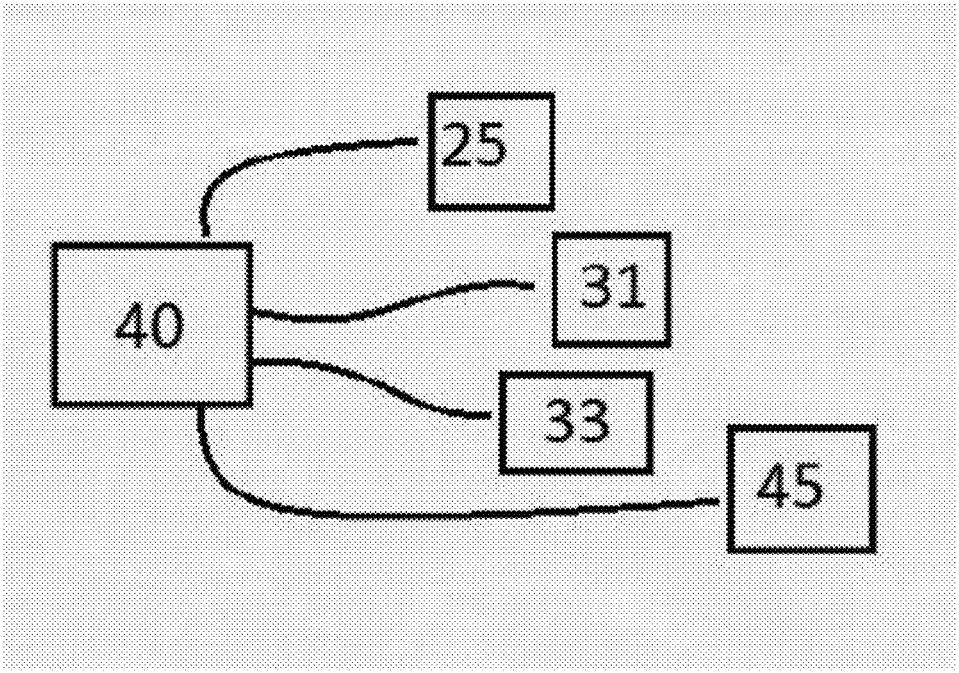
FIG. 12 is a schematic view of a control circuit for the blade assembly.

A first embodiment of the present novel technology is illustrated in FIGS. 1-12, a blade attachment assembly 10 for connecting a movable blade 20 to a skid loader 13. The assembly includes a connection plate 15 to which a blade 20 is slidingly and pivotably connected. The connection plate 15 includes at least one vertical actuator 25, such as an electric motor, a hydraulic piston, or the like, for allowing an operator to remotely (or a control system to automatically) adjust the vertical displacement of the blade 20 relative the skid loader 13 and/or ground. In other words, the blade 20 is connected adjacent the front of the skid loader 13 via one or more (typically a pair of spaced) elevation controllers (such as pneumatic or hydraulic cylinders, electric motors, or the like) operationally connected to the skid loader 13 via the connection plate 15 and to the blade 20 for raising and lowering one or both ends of the blade 20.

In some embodiments, the vertical actuator 25 is also adapted to pivot the blade as well as raise and lower the blade.

The blade 20 is also centrally hinged. The blade 20 includes first and second portions 27, 29, extending from a central hinge 30 connected to the connection plate 15. First and second actuators 31, 33, (such as pneumatic or hydraulic cylinders, electric motors, or the like) are operationally connected to the skid loader 13 via the connection plate 15 and to the respective blade portions 27, 29, with a respective actuator 31, 33 operationally connected to a respective blade half 27, 29 so as to pivot the respective blade half 27, 29 about the hinge 30 when energized by a operationally connected power source/pump 35. The blade 20 may be pivoted from an elongated straight orientation to orientations wherein one or both blade halves or portions 27, 29 are pivoted forward to define an L or V shape. Such forward pivoting allows for directed grading or digging, as well as for increased stability of operation and even gripping objects for carrying or moving.

In some embodiments, the vertical actuator 25 and the pivot actuators 31, 33, are operationally connected to an electronic controller 40. Electronic controller 40 may be part of a control interface for an operator manually controlling or operating the skid loader 10, or electronic controller may be part of a more sophisticated machine control system. One or more sensors 45 may be operationally connected to the electronic controller 40. The one or more sensors 45 may include accelerometers, GPS transponders, optical guidance, distance or proximity sensors, blade position sensors, blade pivot angle sensors, blade elevation sensors, radio transceivers, or the like and combinations thereof.

In operation, during grading one or both blade halves 27, 29 are pivoted away from the plate 15 to define a wedge-shaped blade 20. The wedge-shaped blade configuration is lowered into a desired position for grading, and the skid loader 10 is engaged to move forward. Grading is accomplished with increased stability and control, as the wedge-shape of the blade 20 prevents the blade 20 from 'biting' into uneven ground and likewise prevents the skid loader from bouncing along.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A skid loader blade assembly comprising:

a connection plate;

at least one vertical actuator operationally connected to the connection plate for moving a blade vertically relative to the plate;

the blade operationally connected to the vertical actuator, wherein the blade further comprises a hinge, a first blade portion connected to the hinge, and a second, oppositely disposed blade portion connected to the hinge;

a first pivot actuator operationally connected to the first blade portion;

a second pivot actuator operationally connected to the second blade portion;

an electronic controller operationally connected to the respective actuators; and a sensor operationally connected to the electronic controller;

wherein the electronic controller raises or lowers the first blade portion independent of the second blade portion in response to the sensor to maintain a predetermined grade.

2. The skid loader blade assembly of claim 1 wherein the respective actuators are hydraulic cylinders.

3. The skid loader blade assembly of claim 1 wherein the respective actuators are electric motors.

4. The skid loader blade assembly of claim 1 wherein the sensor is selected from the group consisting of accelerometers, GPS transponders, optical guidance, distance or proximity sensors, blade position sensors, blade pivot angle sensors, blade elevation sensors, radio transceivers, and combinations thereof.

5. A skid loader blade assembly comprising:

a connection plate configured for mounting to a skid loader;

a hinged blade movably connected to the connection plate, wherein the hinged blade further comprises a hinge, a first blade portion connected to the hinge, and a second, oppositely disposed blade portion connected to the hinge;

two vertical actuators operationally connected to the connection plate for moving the blade vertically relative to the plate;

a first pivot actuator operationally connected to the first blade portion; and a second pivot actuator operationally connected to the second blade portion.

6. The skid loader blade assembly of claim 5 wherein the respective actuators are hydraulic cylinders.

7. The skid loader blade assembly of claim 5, further comprising an electronic controller operationally connected to the respective actuators.

8. The skid loader blade assembly of claim 7, further comprising a sensor operationally connected to the electronic controller.

9. The skid loader blade assembly of claim 8 wherein the sensor is elected from the group consisting of accelerometers, GPS transponders, optical guidance, distance or proximity sensors, blade position sensors, blade pivot angle sensors, blade elevation sensors, radio transceivers, and combinations thereof.

10. The skid loader blade assembly of claim 9 wherein the electronic controller raises or lowers the first blade portion independent of the second blade portion in response to the sensor to maintain a predetermined grade.

* * * * *